United States Patent [19]

Iriyama et al.

[11] Patent Number: 4,694,508

[45] Date of Patent: Sep. 22, 1987

[54] FINGERTIP PROTECTORS FOR WORK GLOVES

[75] Inventors: Shozo Iriyama, Kuwana; Mitsuo Abe, Chita, both of Japan

[73] Assignee: Daido Tokushuko Kabushiki Kaisha, Aichi, Japan

[21] Appl. No.: 905,745

[22] Filed: Sep. 9, 1986

[30] Foreign Application Priority Data

Oct. 16, 1985 [JP] Japan ..... 60-230442

[51] Int. Cl.[4] ..... A41D 19/00

[52] U.S. Cl. ..... 2/21; 2/160; 2/161 R

[58] Field of Search ..... 2/16, 20, 21, 160, 161 R, 2/161 A, 163; 128/157; 294/25, 131; 223/101

[56] References Cited

U.S. PATENT DOCUMENTS

| | | | |
|---|---|---|---|
| 297,355 | 4/1884 | Demne | 223/101 |
| 1,854,047 | 4/1932 | Kurtz, Jr. | 2/21 |
| 2,129,496 | 9/1938 | Hollingsworth | 2/21 |
| 2,564,183 | 8/1951 | Wilson | 128/157 |
| 3,184,756 | 5/1965 | DeLuca, Jr. | 2/21 X |
| 3,229,690 | 1/1966 | Scholl | 2/21 X |
| 3,348,541 | 10/1967 | Loebeck | 2/21 X |
| 3,386,104 | 6/1968 | Casey | 2/21 X |
| 4,127,222 | 11/1978 | Adams | 2/21 X |

FOREIGN PATENT DOCUMENTS

| | | | |
|---|---|---|---|
| 880396 | 6/1953 | Fed. Rep. of Germany | 2/21 |
| 837371 | 6/1960 | United Kingdom | 128/157 |

*Primary Examiner*—Stephen Marcus
*Assistant Examiner*—T. Graveline
*Attorney, Agent, or Firm*—Koda and Androlia

[57] ABSTRACT

A fingertip protector for use with a work glove including a cap adapted to be detachably fitted on a fingertip of a user covering and protecting the fingertip, and a cushion member of a desired thickness secured to both the inner and the outer surfaces of the cap. The cap can have an opening formed in a portion thereof which faces the finger cushion of the user's fingertip when the cap is in use.

1 Claim, 14 Drawing Figures

(a)

(b)

FINGERTIP PROTECTORS FOR WORK GLOVES

BACKGROUND OF THE INVENTION

1. Field of the Invention

The present invention relates to fingertip protectors for use with work gloves, and more particularly to such fingertip protectors which are designed to protect the fingertips of a worker from external shocks and mechanical stresses and to thereby prevent the occurrence of accidental injuries when a worker is engaged in operating a machine and other heavy-duty work that might cause damage to his fingers.

2. Description of the Prior Art

It has been a common practice for a worker to wear fabric or leather work gloves when he operates a machine having exposed moving parts, or when he is engaged in heavy-duty works such as transportation of heavy articles and press operation that might involve certain dangers, so that his hands may be protected from slight bruises and scratches during work. Accordingly, work gloves are provided with rubber coating for waterproofing, electrical insulation, and slip prevention.

In actual workshops, however, there often occur damages to fingertips which can not be prevented by the commonly available work gloves. For example, a worker often gets his fingertips scratched by a grinder. Other common accidents include the crushing of fingertips that occurs when the fingers are caught under a heavy object or when the fingers are caught between a sling and an object to be lifted by a crane. Conventional work gloves are useless from the viewpoint of fingertip protection in heavy-duty work, and the worker's own carefulness has been the only possible way of avoiding accidents.

SUMMARY OF THE INVENTION

The present invention has been proposed to eliminate the above-noted disadvantage that the conventional work gloves do not protect fingertips satisfactorily from external mechanical stresses. It is, therefore, an object of the present invention to provide novel fingertip protectors for use with work gloves wherein the work gloves are worn with the fingertip protectors fitted on the worker's fingertips, to thereby effectively prevent the worker's fingertips from unforeseen accidents.

The foregoing object is accomplished in one embodiment of the invention by providing a fingertip protector for use with a work glove which comprises a cap adapted to be detachably fitted on a fingertip of a user for covering and protecting the fingertip.

In another aspect, the present invention provides a fingertip protector for use with a work glove which comprises a cap adapted to be detachably fitted on a fingertip of a user for covering and protecting the fingertip, and a cushion member of a desired thickness secured to both the inner and the outer surfaces of the cap.

The present invention will become more fully apparent from the claims and description as it proceeds in connection with the drawings.

DETAILED DESCRIPTION OF THE PREFERRED EMBODIMENTS

Figure 1:
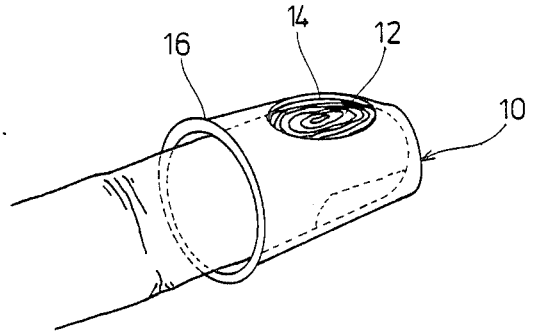
FIG. 1 is a perspective view of a fingertip protector according to one embodiment of the invention, shown with a user's finger cushion facing upward.
Figure 2:
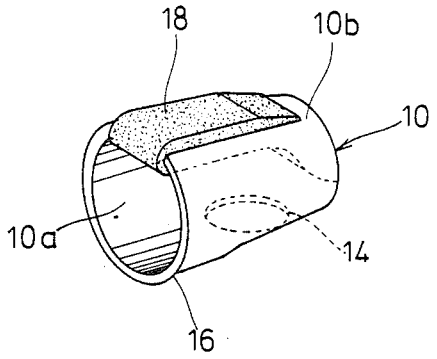
FIG. 2(*a*) and FIG. 2(*b*) are perspective views of a fingertip protector according to another embodiment of the invention.
Figure 2:
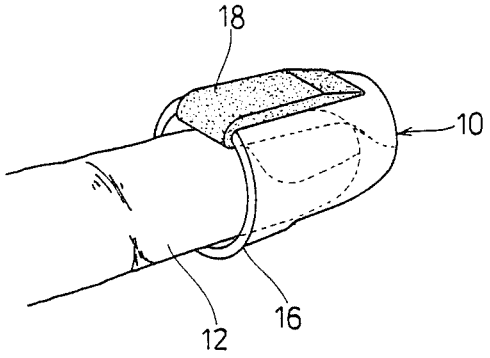
Figure 3:
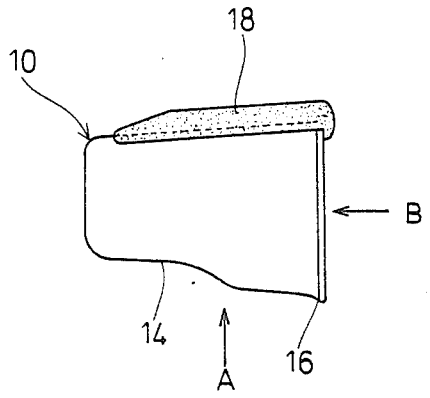
FIG. 3 is a side view of the fingertip protector shown in FIGS. 2(*a*) and 2(*b*)
Figure 4:
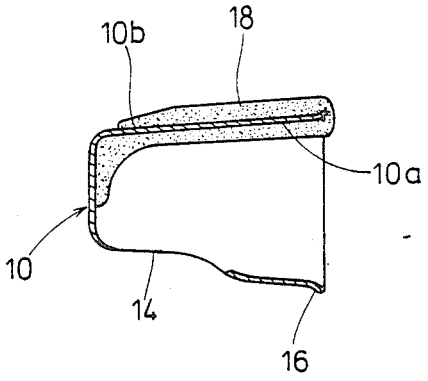
FIG. 4 is a vertical sectional view of FIG. 3.
Figure 5:
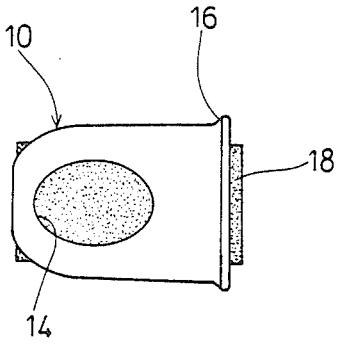
FIG. 5 is a view in the direction of the arrow A in FIG. 3.
Figure 6:
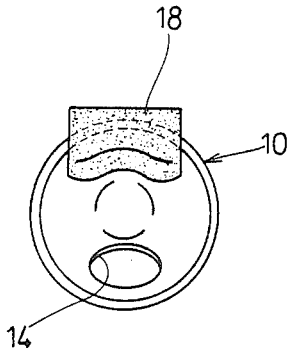
FIG. 6 is a view in the direction of the arrow B in FIG. 3.

Referring to FIG. 1, there is shown a fingertip protector in perspective view to illustrate a preferred embodiment of the invention. The fingertip protector basically comprises a cap 10 adapted to be detachably fitted on a fingertip of a worker so as to cover and protect the fingertip. The illustrated cap 10 may be formed by stamping and extruding a 0.3 to 2.5 mm thick steel sheet. The cap 10 is so shaped that it can accommodate a fingertip therein. Preferably, the cap 10 is made of hardened steel which is not easily crushed by great external forces and shocks applied thereto. However, for relatively light work, the cap 10 may not require very high strength and it may be of any tough molded plastic material including carbon fiber; suitable materials include Kevlar(trademark) and the like.

As may be seen from FIG. 1, the cap 10 has an opening 14 formed in a portion thereof which faces the finger cushion of a user's fingertip 12 when the cap is in use, so that the finger cushion may be exposed slightly outwardly of the cap 10 through the opening 14. Preferably, the cap 10 is provided on its peripheral edge with a rim 16 curved slightly outwardly.

FIGS. 2 to 7 show another embodiment of the invention and as may be seen, a cushion member 18 of a predetermined thickness is folded and bonded to the cap 10 so as to cover a desired portion of the inner surface 10*a* and of the outer surface 10*b* of the cap 10. Specifically, as shown in FIG. 8, the cushion member 18 comprises a sheet of a predetermined thickness and width and of a foamed plastic material such as polyurethane.

Figure 8:
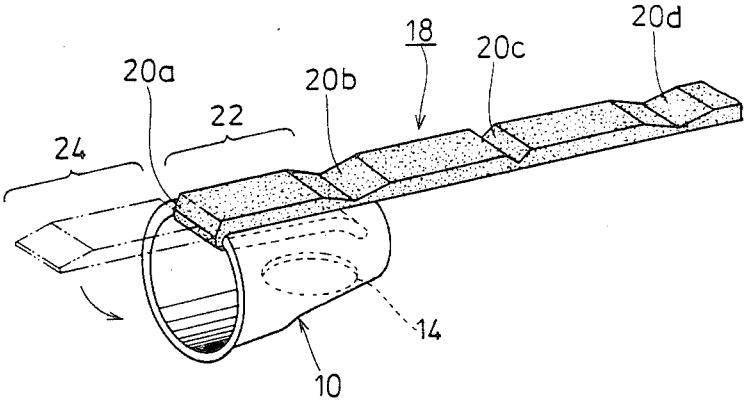
FIG. 8 is a perspective representation of a cushion member of the fingertip protector shown in FIG. 2, illustrating the cushion member in the bonded state.

The cushion sheet has formed thereon a series of regularly spaced transverse notches (only four notches 20*a*, 20*b*, 20*c* and 20*d* are shown in FIG. 8). On the back of the sheet there is applied an adhesive having high bonding strength relative to the material of the cap 10, so that a segment 22 located between the two notches 20*a* and 20*b* may be bonded to the outer surface of the cap 10, as shown in FIG. 8. Further, with the notch 20*a* on one end of the sheet located at the peripheral edge of the cap 10, another segment 24 adjacent the segment 22 is folded about the notch 20*a* toward the inner surface 10*a* of the cap 10. Thus, the cushion member 18 may be conveniently bonded in the manner shown in FIG. 4. It will be noted that each of the notches is tapered at a desired inclination, and that the sheet may be readily cut at the notches into the individual cushion member 18. Thus, the cut end of the cushion member 18 bonded to the inner surface 10*a* of the cap 10 forms a tapered end which gives a good touch to the finger when the cap is fitted on the fingertip.

It is to be noted that the cushion member 18 on the outer surface 10*b* serves to prevent the cap from rotating relative to a glove 26 and from slipping relative to the direction of cap insertion. Also, the cushion member 18 on the inner surface 10*a* serves to adapt the fingertip to the cap 10 when in use as well as to prevent the cap from rotating relative to the fingertip and from slipping relative to the direction of finger insertion. Therefore, the cushion member 18 may cover only to the extent required to achieve the above-noted function; it is not necessarily a requisite for the cushion member to extend over the entire inner and outer surfaces of the cap 10. For this reason, as shown in FIGS. 3 to 7, the cushion member 18 on the inner surface 10*a* of the cap 10 covers only an upper inside portion of the cap 10 adjacent the user's finger nail when in use. Similarly, the cushion member 18 on the outer surface 10*b* of the cap 10 covers only a portion abutting against the upper inside portion of the finger of the glove 26.

As with the cap shown in FIG. 1, the cap 10 according to this embodiment has an opening 14 formed in a portion thereof which faces the finger cushion of a user's fingertip when the cap is in use, so that the finger cushion may be exposed slightly outwardly of the cap 10 through the opening 14. Also, the peripheral edge portion of the cap 10 has a rim 16 bent slightly outwardly.

Figure 9:
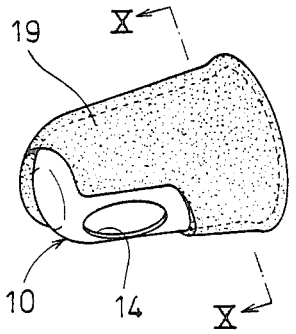
FIG. 9 is a perspective view of a fingertip protector according to still another embodiment of the invention, as looking from underside.
Figure 10:
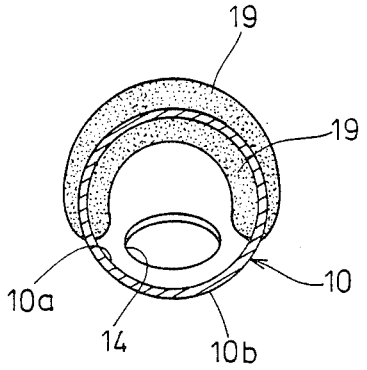
FIG. 10 is a sectional view taken along line X—X of FIG. 9.
Figure 11:
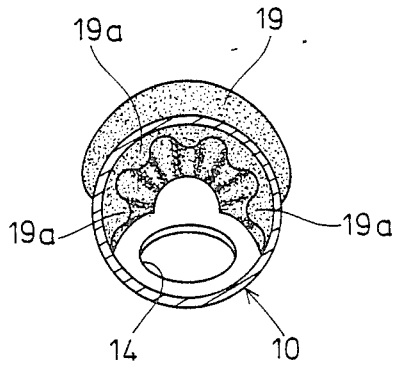
FIG. 11 is a sectional view of a fingertip protector according to a further embodiment of the invention, taken along a plane similar to that of FIG. 10.

FIG. 9 shows still another embodiment of the invention. A cushion member 19, which is formed of a foamed plastic material such as polyurethane, is integrally fusion bonded to the inner surface 10*a* and the outer surface 10*b* of the cap 10. In this embodiment, as shown in FIG. 10, the cushion member 19 is preferably fusion welded to substantially the entire inner and outer surfaces of the cap except the opening 14. Further, as shown in FIG. 11, a part of the cushion member 19 on the inner surface 10*a* of the cap 10 may be provided with a plurality of ridges 19*a*. With this arrangement, ventilation passages are conveniently formed between the cap 10 and the fingertip, serving to eliminate moisture due to sweat.

Figure 12:
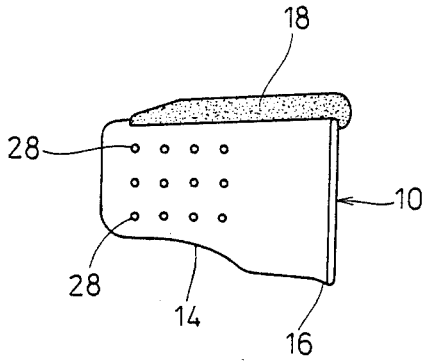
FIG. 12 is a side view of a fingertip protector according to a still further embodiment of the invention.

FIG. 12 shows a modification of the cap 10. As may be seen, the cap 10 has a number of ventilation holes 28 spaced at desired intervals. The number of the ventilation holes 28 is such that they will not impair the strength of the cap 10. The task of the ventilation holes 38 is to eliminate moisture due to sweat. It will be noted that the caps 10 of the invention may be preferably manufactured in different sizes to suit different finger sizes of workers as well as the kind of fingers (e.g., thumbs and little fingers). The caps 10 may be preserved by paints such as lacquer, and thus the caps 10 may be conveniently classified by color to suit different cap sizes.

Figure 7:
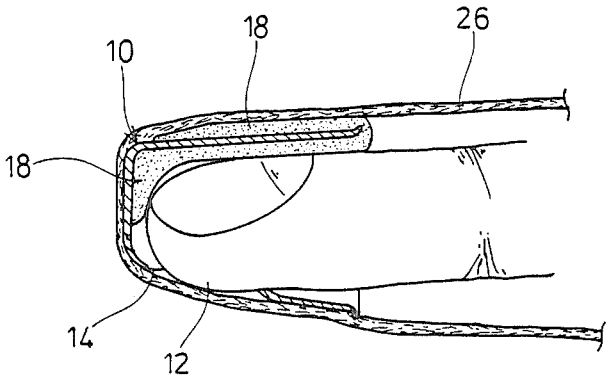
FIG. 7 is a vertical sectional view of the fingertip protector shown in FIG. 2, illustrating the same in practical use.
Figure 13:
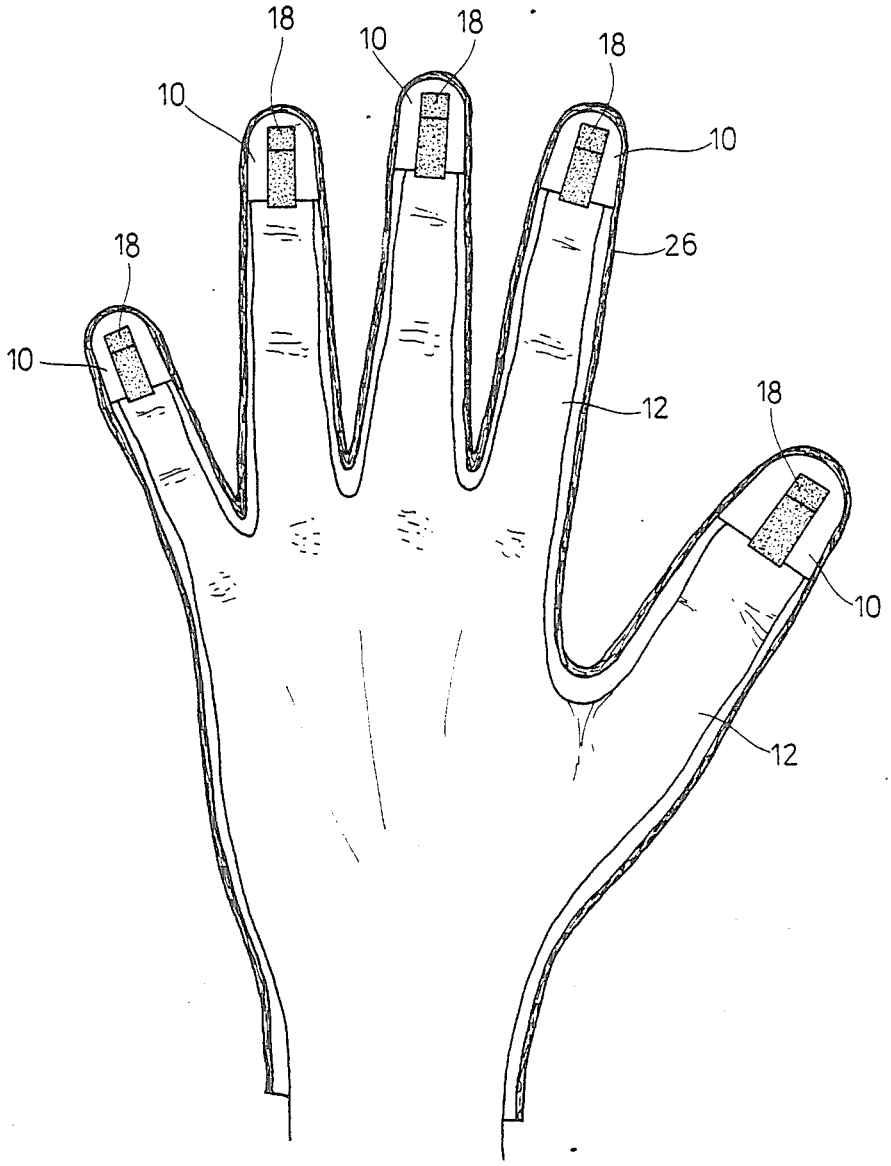
FIG. 13 is a cutaway plan view of the fingertip protectors shown in FIG. 2, illustrating the finger protectors in the operative position fitted on the user's fingertips with a glove put thereon.

Practical use of the illustrated fingertip protector will now be described. As shown in FIGS. 7 and 13, the user fits the fingertip protectors on his fingertips and then, he puts on a work glove 26 with the fingertip protectors fitted on the fingertips. All of the five fingers should be fitted with the fingertip protectors, but a suitable number of protectors may be used as necessary. With the fingertip protectors of FIG. 1, the user can conveniently feel the object he touches through the glove 26 since the cap 10 has the opening 14 which is exposed to the finger cushion of the user. Also, since the fingertips 12 are substantially entirely covered by the fingertip protectors or caps 10, they are protected from scratches, being crushed, fractures, and other injuries when they receive excessive mechanical stresses during heavy-duty work.

Further, in the fingertip protectors using the cushion members shown in FIGS. 2 to 12, the cushion member on the outer surface 10*b* of the cap 10 serves to prevent the cap from rotating relative to the glove 26 and from slipping relative to the direction of cap insertion. Also, the cushion member on the inner surface 10*a* of the cap 10 serves to adapt the fingertip to the cap 10 when in use as well as to prevent the cap from rotating relative to the fingertip and from slipping relative to the direction of finger insertion. The finger size varies more or less with the user; however, the cap 10 can be snugly fitted on the fingertip because of the cushion member provided on the inner surface of the cap.

The fingertip protectors of the invention may be conveniently used without modifying work gloves now commercially available. The fingertip protectors can be conveniently used not only for five-finger gloves but also for mittens and square gloves for heavy-duty works.

It will be noted that fingertip portions of a glove may be provided with rubber or elastically contractible member operable to tighten the fingertip protectors. When such a glove is pulled off, the fingertip protectors may be held within the fingertip portions of the glove. This enables the user to put on the glove without loss of time when next used.

While the invention has been described with reference to preferred embodiments thereof, it is to be understood that modifications or variations may be easily made without departing from the spirit of this invention which is defined by the appended claim.

What is claimed is:

1. A fingertip protector for use with a work glove comprising a cap adapted to be detachably fitted on a fingertip of a user for covering and protecting said fingertip, said cap having an opening which faces the finger cushion of the user's finger when said cap is in use and a cushion member to be secured to both the inner and the outer surfaces of said cap, wherein:

said cushion member is made from a sheet of foamed plastic material having a predeterimined width, said sheet having thereon a series of parallel spaced transverse tapered notches for being cut at and folded about the tapered notches to form said cushion member, such that said cushion member extends from the outer surface of said cap to the inner surface thereof so that a tapered end of said cushion member is disposed on the inner surface of said cap.

* * * * *